US007701317B2

(12) United States Patent
Sullivan et al.

(10) Patent No.: US 7,701,317 B2
(45) Date of Patent: Apr. 20, 2010

(54) LOW AC RESISTANT FOIL WINDING FOR MAGNETIC COILS ON GAPPED CORES

(75) Inventors: Charles Roger Sullivan, West Lebanon, NH (US); Jennifer Pollock, Hanover, NH (US)

(73) Assignee: The Trustees of Dartmouth College, Hanover, NH (US)

( * ) Notice: Subject to any disclaimer, the term of this patent is extended or adjusted under 35 U.S.C. 154(b) by 257 days.

(21) Appl. No.: 11/547,831

(22) PCT Filed: Mar. 29, 2005

(86) PCT No.: PCT/US2005/010487

§ 371 (c)(1),
(2), (4) Date: Oct. 19, 2007

(87) PCT Pub. No.: WO2005/096330

PCT Pub. Date: Oct. 13, 2005

(65) Prior Publication Data

US 2008/0169893 A1 Jul. 17, 2008

Related U.S. Application Data

(60) Provisional application No. 60/557,268, filed on Mar. 29, 2004.

(51) Int. Cl.
*H01F 17/06* (2006.01)

(52) U.S. Cl. ..... 336/178; 336/225; 336/231; 29/602.1

(58) Field of Classification Search ..... 336/178, 336/225, 231; 29/602.1
See application file for complete search history.

(56) References Cited

U.S. PATENT DOCUMENTS

| | | | | |
|---|---|---|---|---|
| 2,285,798 | A * | 6/1942 | Bergtold | 336/75 |
| 3,195,088 | A | 7/1965 | Rolland | |
| 4,047,138 | A * | 9/1977 | Steigerwald | 336/100 |
| 4,728,390 | A * | 3/1988 | Yamamoto et al. | 216/48 |

FOREIGN PATENT DOCUMENTS

| | | | |
|---|---|---|---|
| EP | 0461712 | A1 | 12/1991 |
| EP | 576249 | A1 * | 12/1993 |
| GB | 1451842 | A | 10/1976 |
| GB | 2037089 | A * | 7/1980 |
| WO | WO 9217892 | A1 * | 10/1992 |

OTHER PUBLICATIONS

PCT/US2005/010487 International Search Report & Written Opinion, mailed Aug. 16, 2005, 9 pages.
PCT/US2005/010487 International Preliminary Report on Patentability, Sep. 29, 2006, 6 pages.

(Continued)

*Primary Examiner*—Elvin G Enad
*Assistant Examiner*—Tszfung Chan
(74) *Attorney, Agent, or Firm*—Lathrop & Gage LLP

(57) ABSTRACT

A system and method reduces AC losses in a magnetic coil with a magnetic core with one or more gaps. A foil winding is formed with one or more cavities and is positioned about the magnetic core such that the cavities are adjacent to the gaps.

15 Claims, 7 Drawing Sheets

OTHER PUBLICATIONS

Chinese Patent Application No. 200580010166.0, Letter with English language summary (redactions) and Office Action dated Dec. 19, 2008, 6 pages.

Chinese Patent Application No. 200580010166.0, Letter and claim amendments dated Mar. 16, 2009, 10 pages.

Chinese Patent Application No. 200580010166.0, Letter dated Jun. 16, 2009, 1 page.

Chinese Patent Application No. 200580010166.0, Letter and claim amendments dated Jun. 30, 2009, 6 pages.

Chinese Patent Application No. 200580010166.0, Letter dated Sep. 7, 2009 and Notice of Allowance, 3 pages.

European Patent Application No. 05731442.9, Decision to Grant a European Patent, Aug. 13, 2009, 2 pages.

European Patent Application No. 05731442.9, Intention to Grant a European Patent, Apr. 2, 2009, 29 pages.

European Patent Application No. 05731442.9, Reply to Official Communication pursuant to Article 94(3) EPC, Dec. 5, 2008, 14 pages.

European Patent Application No. 05731442.9, Communication pursuant to Article 94(3) EPC, Jun. 5, 2008, 5 pages.

* cited by examiner

LOW AC RESISTANT FOIL WINDING FOR MAGNETIC COILS ON GAPPED CORES

CROSS-REFERENCE TO RELATED APPLICATIONS

This application claims the benefit of priority of U.S. Provisional Patent Application No. 60/557,268, filed 29 Mar. 2004 and incorporated herein by reference.

BACKGROUND

A magnetic coil may carry a large DC current and an AC ripple current. Any AC loss in the magnetic coil, even when the AC current is small compared to the DC current, may be significant.

One method of reducing AC losses (sometimes described in terms of reducing AC resistance) in a magnetic coil is to use litzendraht (litz) wire. Litz wire is constructed from a plurality of insulated wire strands, and, in theory, has lower AC resistance than a single wire strand of the same cross-sectional area. An AC current travels near the surface of a conductor; an effect known as skin effect. Litz wire may reduce this skin effect when properly twisted and woven. Another effect that causes losses in a magnetic coil is the proximity effect, which occurs where the magnetic field created by a first wire or strand produces eddy currents in a second wire or strand. Litz wire may reduce proximity effect.

One disadvantage of litz wire is that it has a higher DC resistance, compared to a single strand wire of the same cross sectional area, making it undesirable for applications where DC current is large compared to AC current. Litz wire also has a higher cost than single strand wire and foil.

Another technique for reducing AC losses in a magnetic coil is to use an optimized-shape wire winding that positions wire (which may be litz wire) away from any gaps in a magnetic core. Disadvantages of using optimized shape wire winding include a more difficult and expensive winding and, if litz wire is used, the same increased DC resistance.

Yet another technique for reducing AC losses in a magnetic coil is to use multiple small gaps in the magnetic core instead of a single large gap. However, this increases the cost of the magnetic coil; it has also been shown that an optimized winding shape may be superior to the use of the multi-gapped magnetic core approach.

Typically, magnetic coils that carry high DC current (e.g., high power inductors, flyback transformers, etc.) are constructed with foil windings. Foil windings have low DC resistance, but, as with a multi-layer winding, AC losses are, in some cases, proportional to the square of the number of layers. Magnetic coils used in power applications typically require an air gap in the magnetic core to prevent magnetic saturation, to control inductance and to store magnetic energy. In high frequency applications (also in low-frequency applications), such as those incorporating switching power converters the magnetic field near this air gap induces large AC losses in the magnetic coil, particularly, in portions of the winding near the gap.

Although the above techniques, particularly the optimized shape winding, may be effective, the DC current in designs incorporating these techniques is much larger than the AC current; it is therefore not acceptable to significantly increase DC resistance. For high DC current windings, copper foil is often used since it is possible to achieve a higher packing factor (the portion of the winding window containing copper) than can be achieved with round wire. However, copper foil windings are particularly susceptible to induced eddy current from the gap fringing field. This is because the fringing field contains magnetic flux components perpendicular to the plane of the foil, which can produce significant losses even when the AC current is much smaller than the DC current in the winding.

FIG. 1 illustrates an exploded three dimensional representation of a foil wound magnetic coil 10. Magnetic coil 10 is shown with a magnetic core 12 and a foil wound coil 14. Foil wound coil 14 is shown removed from center leg 16 of magnetic core 12 for purposes of illustration (i.e., in normal operation, center leg 16 extends through center hole 15 of foil wound coil 14; see FIG. 2, FIG. 3A, FIG. 3B). Center leg 16 has a gap 18 to prevent magnetic saturation of magnetic coil 10 during operation. Magnetic core 12 has two winding windows 20 and 22. FIG. 2 illustrates a front elevation of magnetic coil 10, showing magnetic core 12 with foil coil 14 installed on center leg 16.

FIG. 3A illustrates a vertical cross-section A-A through magnetic coil 10 with foil wound coil 14 installed on center leg 16 of magnetic core 12. FIG. 3A illustrates magnetic core 12 and a copper foil winding 30 of foil wound coil 14. Copper foil winding 30 is shown filling winding windows 20 and 22 of magnetic core 12.

FIG. 3B shows an enlargement 40 of an area around gap 18 of cross-section A-A, FIG. 3A. Enlargement 40 shows inner copper foil winding 30 surrounding center leg 16 and a gap fringing field 32 that occurs around gap 18 during operation of magnetic coil 10. In particular, gap fringing field 32 induces eddy currents in copper foil winding 30 that increase AC losses, particularly for high frequency AC currents.

It is thus desirable to remove or minimize the effect of gap fringing field 32 on foil winding 30 to reduce AC losses without significantly increasing the DC resistance of magnetic coil 10.

DETAILED DESCRIPTION OF THE FIGURES

The magnetic coil described hereinbelow uses a magnetic core with one or more gaps and a foil winding that does not extend completely across a winding window in the region of the gaps in the magnetic core, thus reducing the AC resistance of the magnetic coil and, hence, AC losses.

Figure 4:
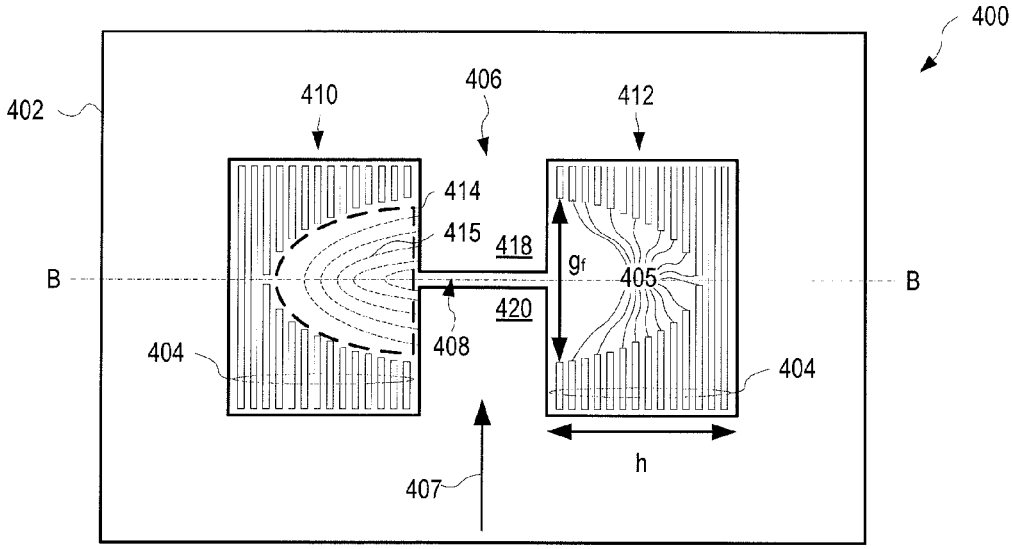
FIG. 4 is a vertical cross-section through a magnetic coil illustrating a magnetic core with a single gap in center leg and an optimal shaped cavity in a copper foil winding.

FIG. 4 is a vertical cross-section through a magnetic coil 400, illustrating a magnetic core 402 with a center leg 406 in two sections. FIG. 4 is illustrative and may not be drawn to scale. The two sections of center leg 406 may be considered as a first post 418 and a second post 420. First post 418 and second post 420 of center leg 406 define an axis 407; a single gap 408 is centered upon a plane of symmetry B-B that is normal to axis 407. A copper foil winding 404 circumscribes the first post and second post of center leg 406, and a 408, as shown. Magnetic core 402 has winding windows 410 and 412 that contain copper foil winding 404, as shown. A gap fringing field 415, created by gap 408, is shown in winding window 410. A similar gap fringing field occurs in window 412, but is not shown for clarity of illustration. Copper foil winding 404 has copper removed to form a cavity 414 that is centered about gap 408 in plane of symmetry B-B, as shown. Cavity 414 prevents or reduces gap fringing field 415 from creating eddy currents in winding 404 that would cause AC losses in magnetic coil 400.

Copper foil winding 404 is cut away near gap 408 as illustrated by cavity 414. Cavity 414 illustrates a nearly semicircular cavity shape (i.e., the width of the largest foil gap $g_f$ is approximately equal to the width h of winding window 412) suitable for large AC currents (i.e., where the AC current is a large fraction of the DC current within foil winding 404). As the AC current becomes a smaller fraction of the DC current in foil winding 404, foil gap $g_f$ may be reduced since AC losses may be less significant. Since removal of foil to form cavity 414 increases DC losses in winding 404 but reduces AC losses (e.g. as compared to a winding 404 without cavity 414), the size and shape of cavity 414 near gap 408 may be adjusted to optimize the tradeoff between DC losses and AC losses.

Figure 1:
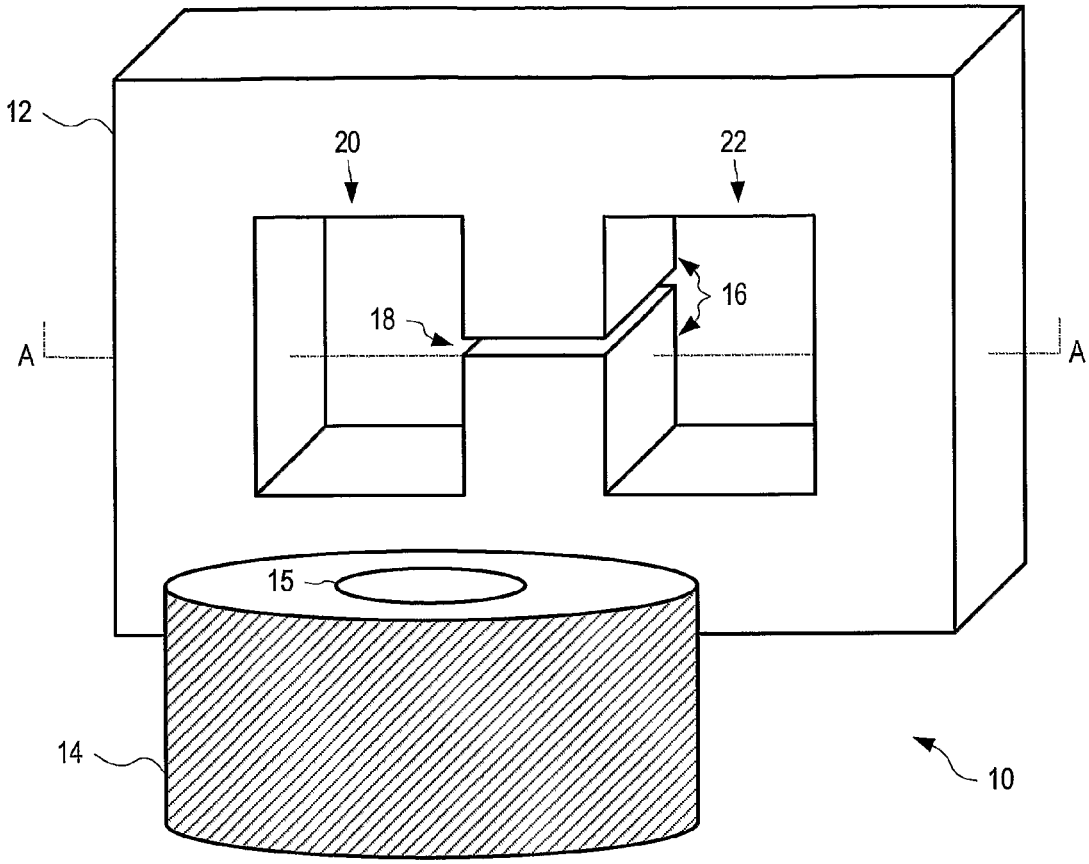
FIG 1 PRIOR ART
FIG. 1 illustrates an exploded three dimensional prior art representation of a foil wound magnetic coil 10.
Figure 2:
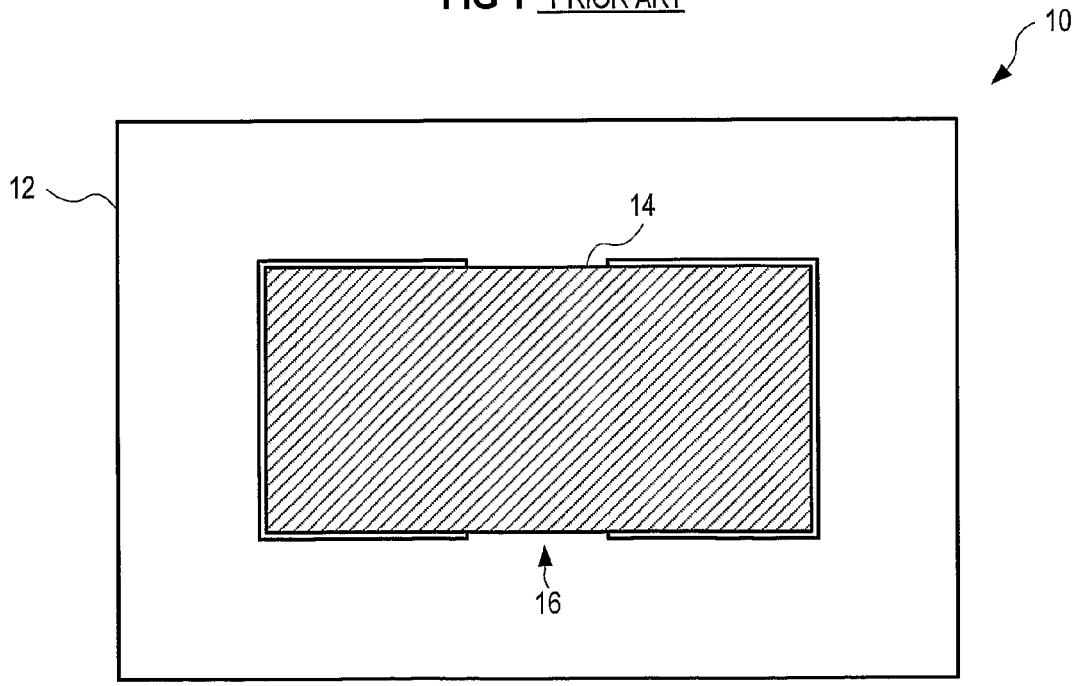
FIG 2 PRIOR ART
FIG. 2 illustrates a front elevation of the magnetic coil of FIG. 1.
Figure 3A:
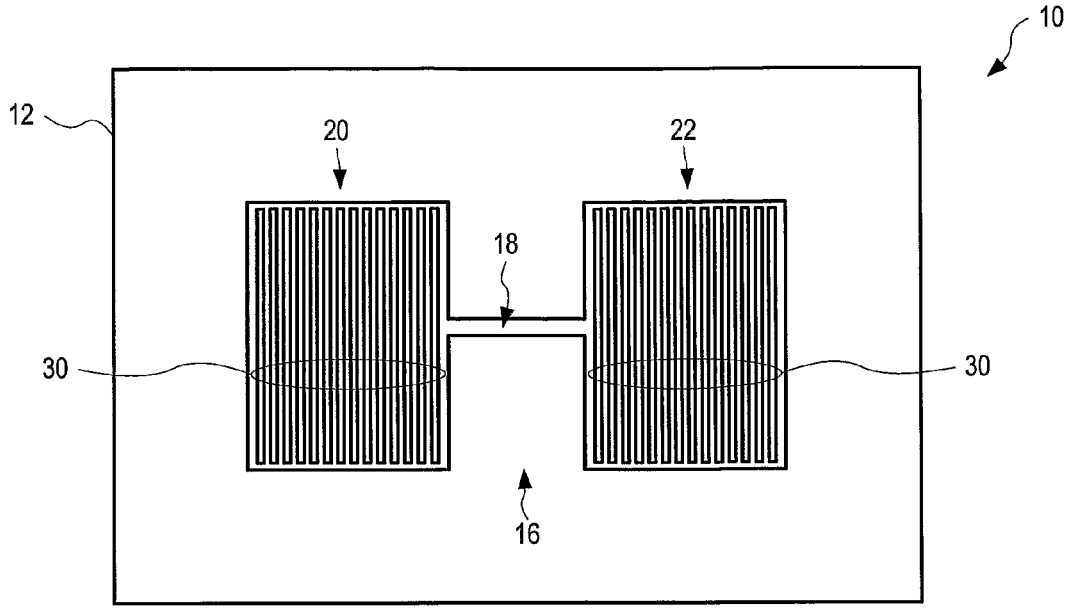
FIG 3A PRIOR ART
FIG. 3A illustrates a vertical cross-section through the magnetic coil of FIG. 1.
Figure 3B:
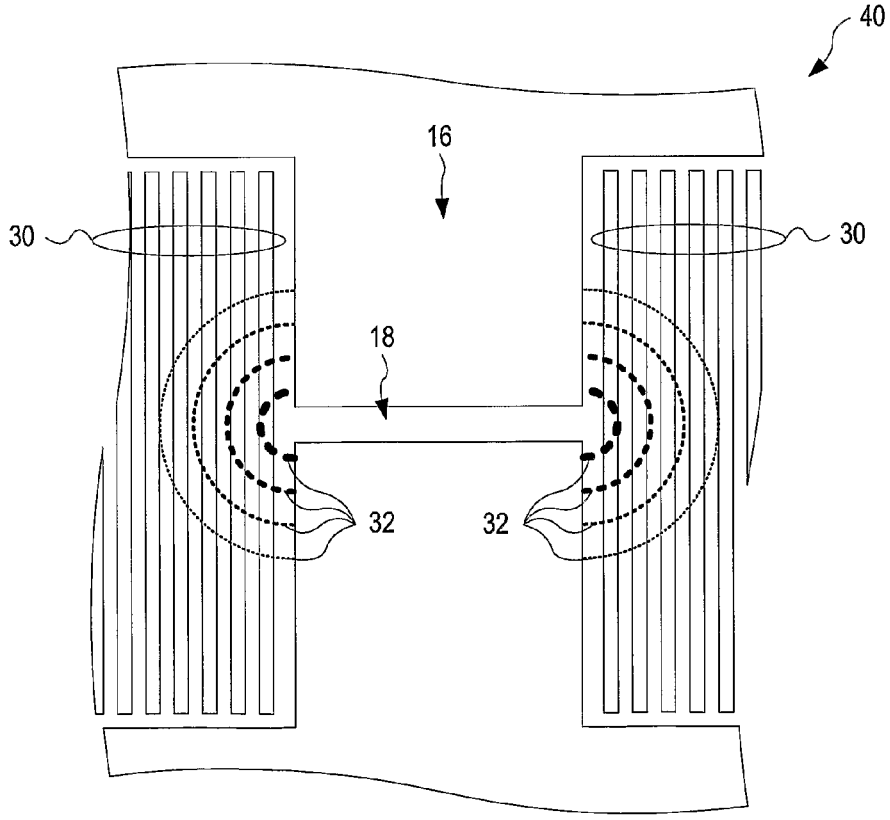
FIG 3B PRIOR ART
FIG. 3B shows an enlargement of an area around the gap of the cross-section of FIG. 3A.

There are several ways to explain certain advantages that may occur with this configuration. One explanation is that there is less copper in the region of gap 408, and so fewer eddy currents are induced by gap fringing field 415. Another explanation involves the distribution of high-frequency current in winding 404. That is, in a simple foil winding, with layers thick compared to a skin depth, opposing currents flow on opposite sides of the winding such that the bottom winding layer has current on the surface facing gap 408 that is N times the terminal current, where N is the number of turns (equal to the number of layers for a foil winding). This current is concentrated near gap 408, in the first layer. The high-frequency current mostly flows near exposed edges 405 of each turn of copper foil winding 404 (edges 405 are shown in window 412, but not all edges 405 are labeled, and edges 405 are not shown in window 410, for clarity of illustration). Since there is no intervening copper between where the AC current flows and gap 408, no additional (or appreciable) eddy currents are induced by the magnetic field caused by gap 408. Although exposed edges 405 created by cavity 414 are small compared to the overall foil cross sectional area (e.g., area of winding window 410), the resulting AC resistance is reduced (in comparison to that of the prior art, such as shown in FIG. 1). The reason that low AC resistance (and, therefore, low AC losses) occurs—when both $g_f$ is approximately equal to width h of winding window 412 and cavity 414 is semicircular—is that edges 405 are approximately equidistant from gap 408, such that approximately equal AC current density exists within each edge 405 of winding 404.

As $g_f$ increases beyond width h (see FIG. 4), AC resistance increases (with increasing AC losses). However, in certain circumstances, larger values of $g_f$ may be desirable, since AC losses are still reduced when $g_f$ is greater than twice width h of winding window 412, as compared to AC losses in a foil winding with no cavity.

Benefits may also exist in incorporating cavities in foil windings used with only high frequency AC currents.

Figure 5:
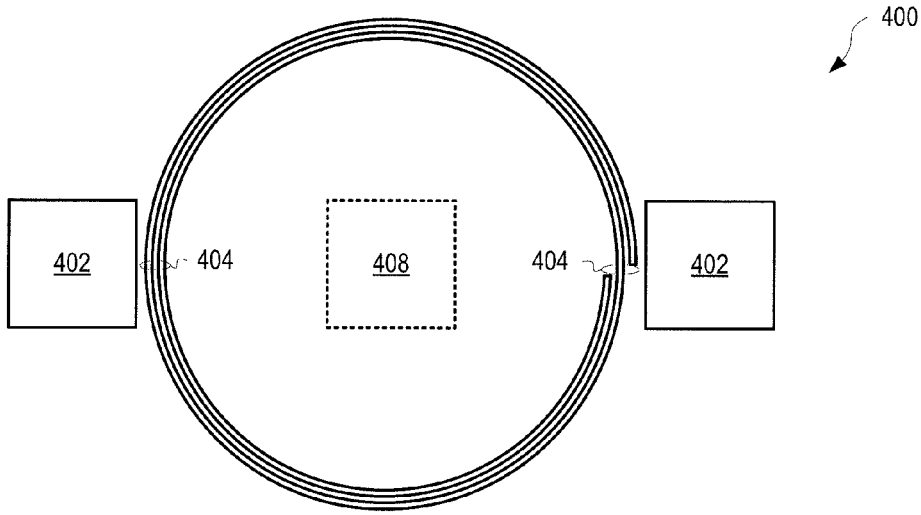
FIG. 5 shows a horizontal cross-section through the magnetic coil of FIG. 4, illustrating the cavity in the winding around the center leg of the magnetic core.

FIG. 5 shows a horizontal cross section B-B through magnetic coil 400, FIG. 4, illustrating winding 404 around center leg 406 of magnetic core 402. FIG. 5 is illustrative and may not be drawn to scale. Winding 404 is shown cut away around center leg 406 such that gap fringing field 415, created by gap 408, does not appreciably induce eddy currents in winding 404.

Figure 6:
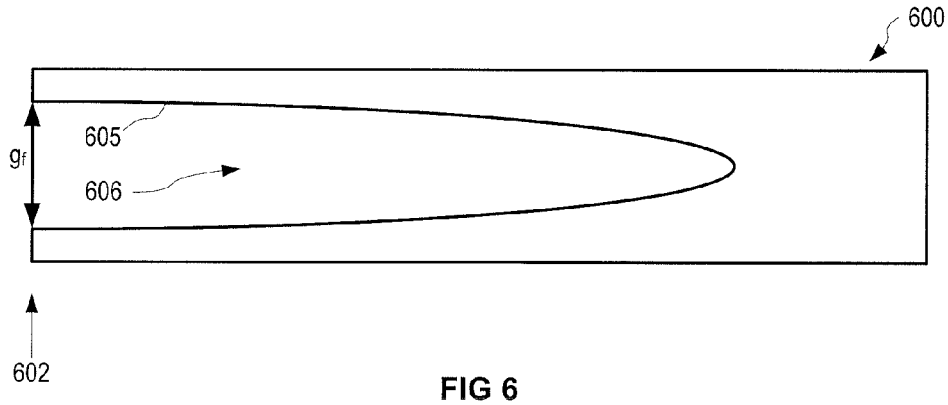
FIG. 6 illustrates a foil with a cutout that forms the cavity shown in FIG. 4.

FIG. 6 illustrates a cutout 606 in a foil 600. When foil 600 is wound, starting at end 602, cavity 414 of FIG. 4 may be created; inner edge 605 of foil 600 forms edges 405 of FIG. 4. Cutout 606 has a width $g_f$ at end 602, corresponding to width $g_f$ of cavity 414, as shown. Foil 600 is shown foreshortened (i.e., not to scale) for purposes of illustration. Foil 600 may thus be cut to form cutout 606, prior to, or during, a foil winding process to create winding 404.

Figure 7:
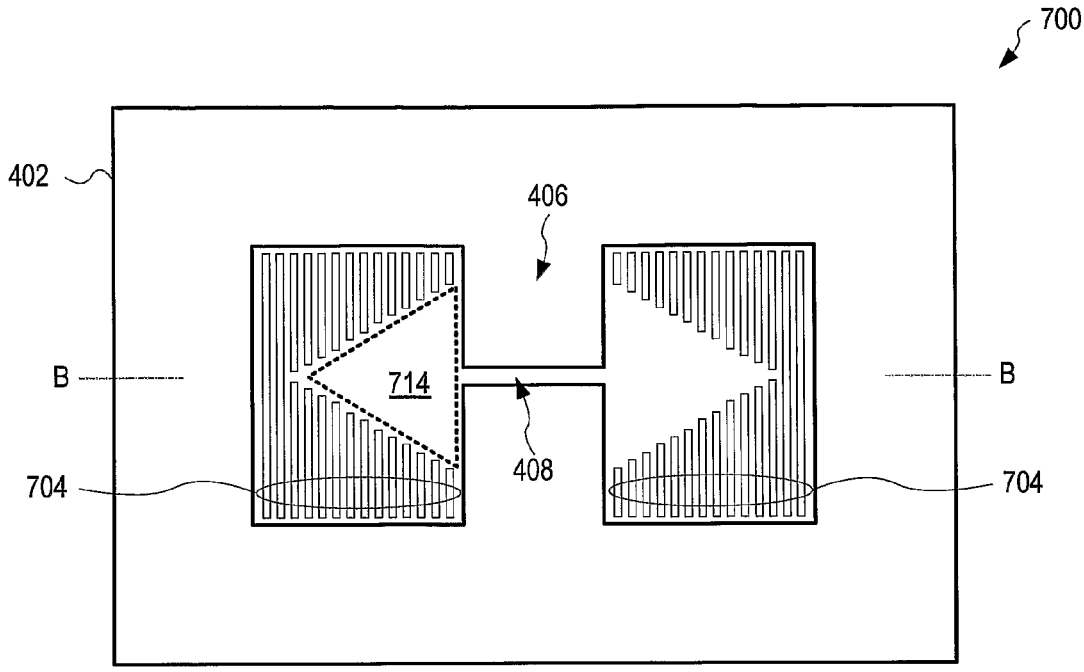
FIG. 7 is a vertical cross-section through a magnetic coil illustrating a magnetic core with single gap in a center leg and a foil winding with a 'V' shaped cavity.
Figure 8:
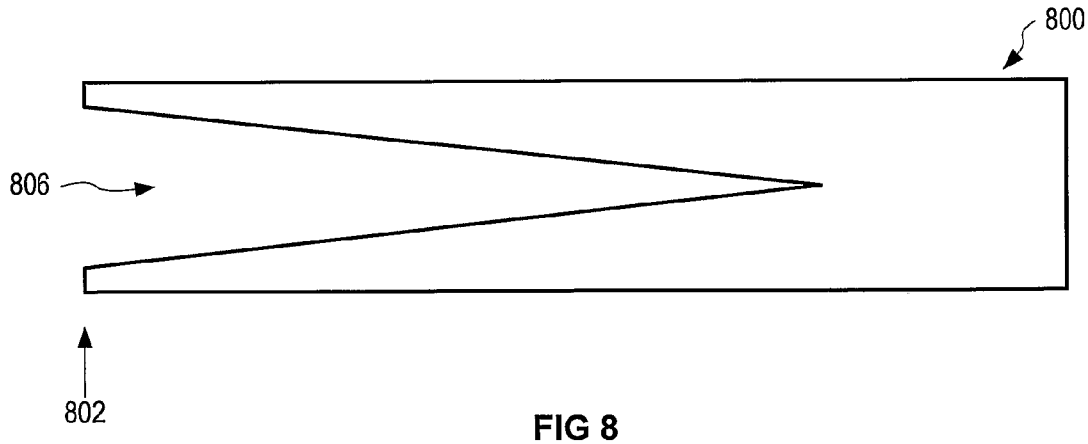
FIG. 8 shows a foil with a cutout that forms the cavity of FIG. 7.

FIG. 7 and FIG. 8 may be viewed together in connection with the following description. FIG. 7 and FIG. 8 are illustrative and may not be drawn to scale. FIG. 7 is a vertical cross section through a magnetic coil 700 illustrating magnetic core 402 with single gap 408 in center leg 406, and a copper foil winding 704 with a 'V' shaped cavity 714. FIG. 8 shows a foil 800 with a cutout 806 such that, when wound (starting at end 802) to form winding 704, cavity 714 forms. Foil 800 and winding 704 may be easier, and thus cheaper, to manufacture than winding 404 of magnetic coil 400. In one embodiment, foil 800 may be constructed of two or more separate trapezoidal foil pieces that are wound together to form winding 704 with cavity 714.

Although an ideal cavity shape for minimum AC resistance may be semicircular, a 'V' shape may be easier to cut, and in many circumstances, may be used instead of the semicircular shape to save cost. The small improvement achieved with a semicircle gives better performance where large AC currents occur in the magnetic coil. Additionally, where the AC current is small, with respect to the DC current in the winding, the size of the cavity may be reduced in several ways: a) the width of the semicircle may be reduced, making it elliptical, b) the radius of the semicircle may be reduced (i.e., the winding layers furthest from the gap may not be cut out at all), and c) features of both an ellipse and a V may be used. Other shapes (which may or may not approximate a semicircle and/or a V) may be used for cavities 414 and 714 without departing from the scope hereof.

Figure 9:
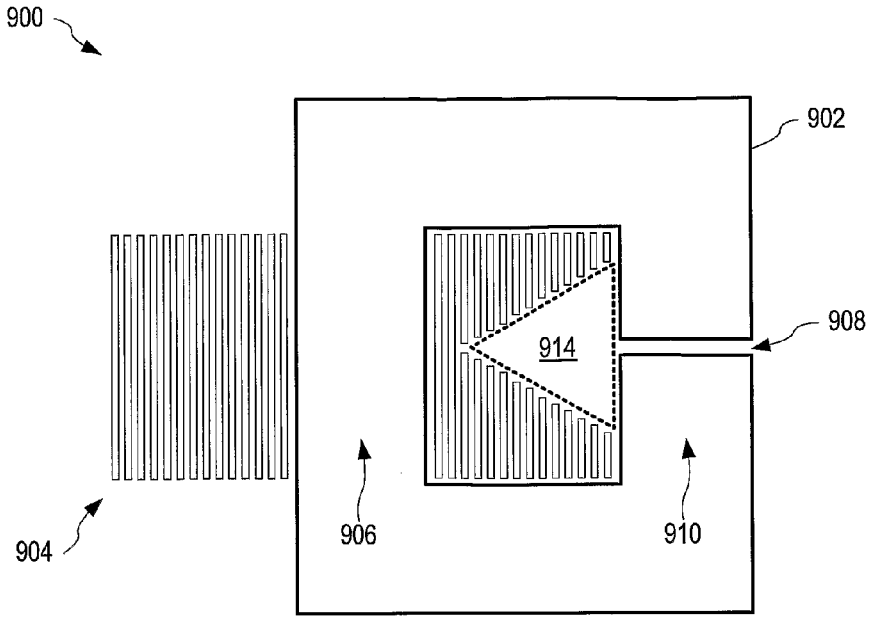
FIG. 9 is a vertical cross section through a magnetic coil that has a magnetic core with a gap in a leg external to a cavity formed by a winding.

FIG. 9 is a vertical cross section through a magnetic coil 900 that has a magnetic core 902 with a gap 908 in a leg 910 external to a winding 904. FIG. 9 is illustrative and may not be drawn to scale. Winding 904 is wound around a non-gapped leg 906 of magnetic core 902 and has a 'V' shaped cavity 914.

Figure 10:
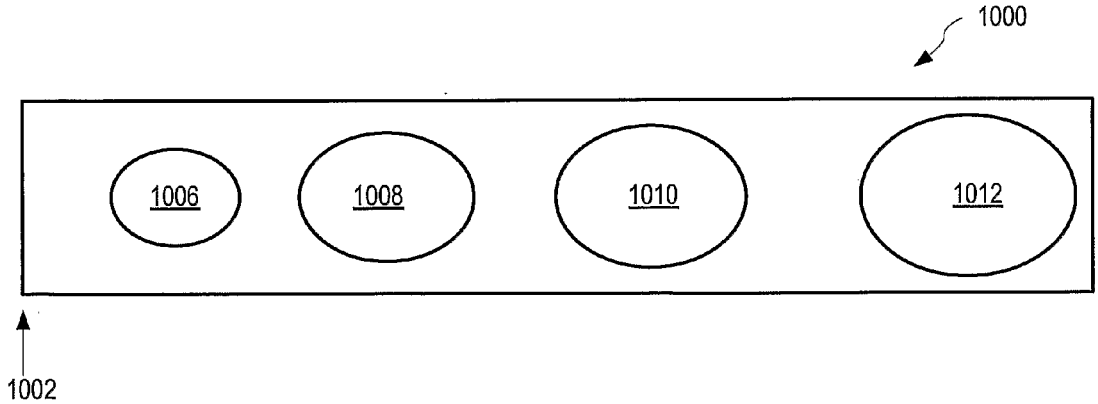
FIG. 10 shows a foil with circular cutouts that form the cavity shown in FIG. 9.
Figure 11:
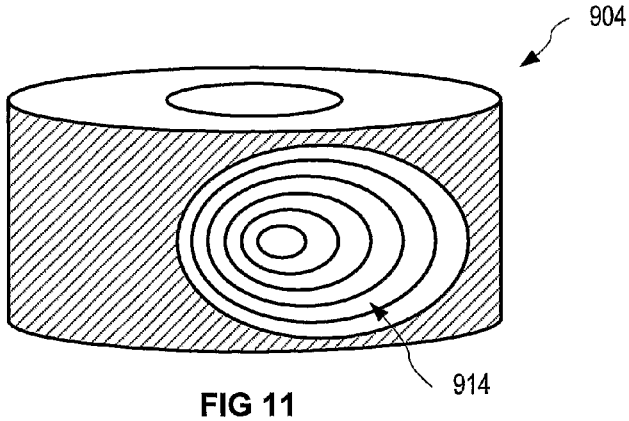
FIG. 11 shows the winding of FIG. 9, removed from the magnetic core, to illustrate the conical cavity formed by the circular cutouts of FIG. 10.

FIG. 10 shows a foil 1000 with elliptical cutouts 1006, 1008, 1010 and 1012. Cutouts 1006, 1008, 1010 and 1012 are elongated to maintain equidistance from gap 908 to the edge of foil 1000 around each cutout. FIG. 10 is illustrative and may not be drawn to scale. The shape of cutout 1012, for example, may include straight lines (top and bottom) corresponding to the linearity of gap 908 in the plane of cutout 1012. Cutouts 1006, 1008, 1010 and 1012 are spaced and sized such that when foil 1000 is wound (starting at end 1002) to form winding 904, cutout 1012 is positioned above cutout 1010; cutout 1010 is positioned above cutout 1008; and cutout 1008 is positioned above cutout 1006. Cutouts 1006, 1008, 1010 and 1012 thereby form cavity 914 in winding 904. FIG. 11 shows winding 904 removed from magnetic core 902 to illustrate conical cavity 914 formed by cutouts 1006, 1008, 1010 and 1012. FIG. 11 is illustrative and may not be drawn to scale. As appreciated, additional or fewer cutouts may be made at appropriate intervals on foil 1000 to form cavity 914 of winding 904. In another embodiment, a cutting tool may be used to produce cavity 914 after winding 904 has been formed.

Figure 12:
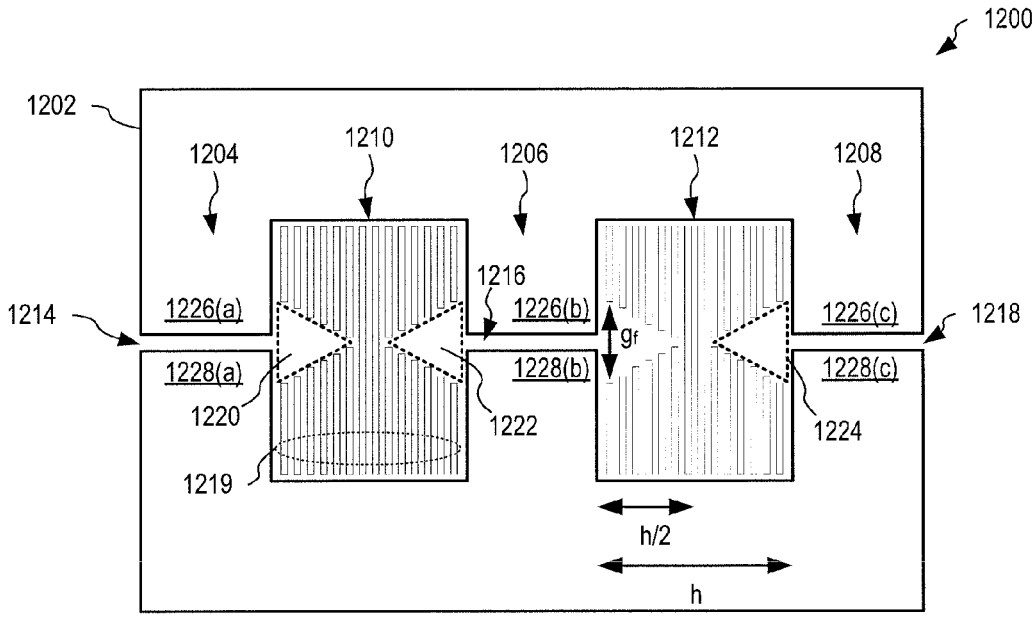
FIG. 12 is a vertical cross-section through a magnetic coil illustrating a magnetic core with multiple gaps.

FIG. 12 is a vertical cross-section through a magnetic coil 1200 illustrating a magnetic core 1202 with multiple gaps 1214, 1216 and 1218 in three legs 1204, 1206 and 1208, respectively, and a foil winding 1219. FIG. 12 is illustrative and may not be drawn to scale. Each of the three legs 1204, 1206 and 1208 are formed as a set having two sections, one on either side of the corresponding gap. Each such set of sections may be considered as a first post (e.g., one of posts 1226(*a*), 1226(*b*) and 1226(*c*) and a second post (e.g., one of posts 1228(*a*), 1228(*b*) and 1228(*c*). Magnetic core 1202 has winding windows 1210 and 1212 around center leg 1206 that contain copper foil winding 1219, as shown. Copper foil winding 1219 has copper removed from the area around gaps 1214, 1216 and 1218, as illustrated by cavities 1220, 1222 and 1224, to prevent or inhibit eddy currents that cause AC losses in magnetic coil 1200.

Winding window 1212 of magnetic coil 1200 has a width h. Since winding window 1212 has gaps 1216 and 1218 on either side, the optimum width $g_f$ of cavities 1222 and 1224 is equal to approximately h/2. Similarly, since winding window 1210 has dimensions equal to those of winding window 1212, the optimum width of cavity 1220 is also approximately h/2.

Figure 13:
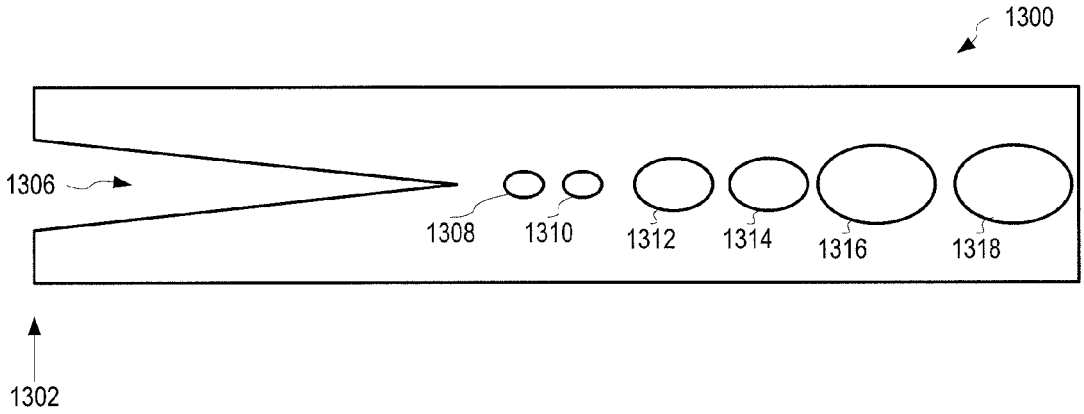
FIG. 13 shows a foil with cutouts suitable for producing the winding of FIG. 12.

FIG. 13 shows a foil 1300 with cutouts 1306, 1308, 1310, 1312, 1314, 1316 and 1318 suitable for producing winding 1219 of FIG. 12. FIG. 13 is illustrative and may not be drawn to scale. Foil 1300 is wound (starting at end 1302) such that cutout 1306 produces cavity 1222, cutouts 1308, 1312 and 1316 are positioned above one another to form cavity 1220, and cutouts 1310, 1314 and 1318 are positioned above one another to form cavity 1224. As appreciated, additional or fewer cutouts may be made at appropriate intervals on foil 1300 to form cavities 1220, 1222 and 1224 of winding 1219.

Figure 14:
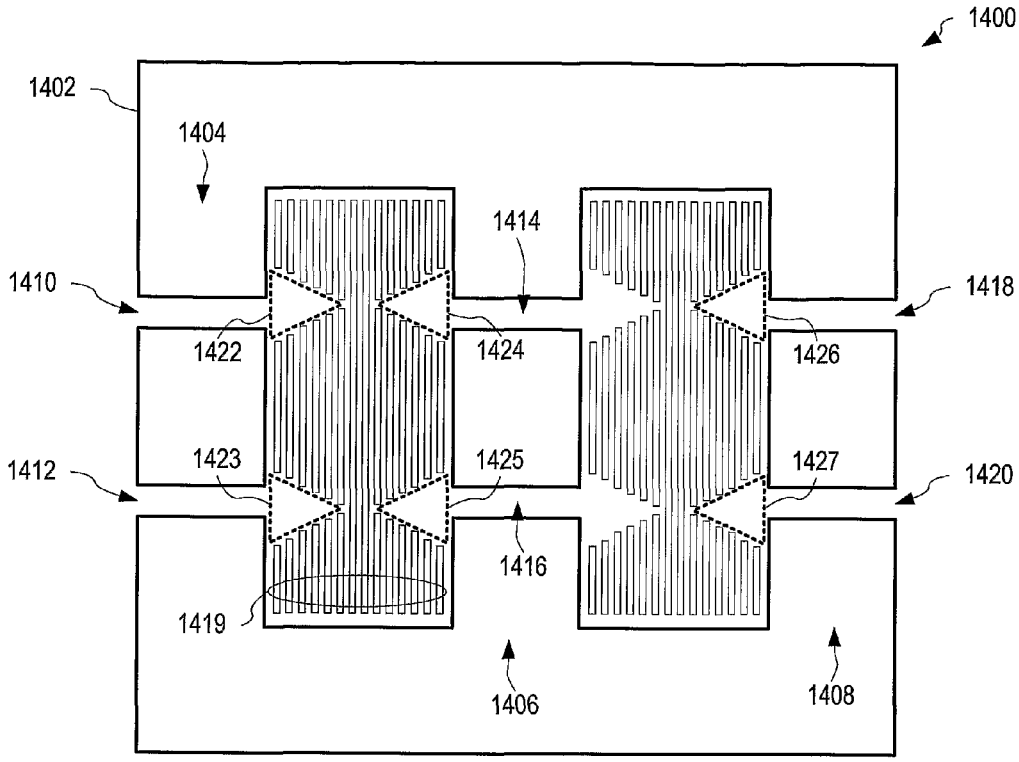
FIG. 14 illustrates a magnetic core with six gaps and a winding that forms cavities.

AC resistance can be further decreased in magnetic coil designs for large AC currents by including multiple gaps in the magnetic coil's magnetic core and by forming a cavity in the foil winding adjacent to each gap. FIG. 14 illustrates a magnetic coil 1400 with a magnetic core 1402 that has six gaps. Specifically, magnetic core 1402 has two gaps 1410, 1412 in a left leg 1404, two gaps 1414, 1416 in a center leg 1406, and two gaps 1418, 1420 in a right leg 1408. FIG. 14 is illustrative and may not be drawn to scale. A winding 1419 includes cavity 1422 adjacent to gap 1410; cavity 1423 adjacent to gap 1412; cavity 1424 adjacent to gap 1414; cavity 1425 adjacent to gap 1416; cavity 1426 adjacent to gap 1418; and cavity 1427 adjacent to gap 1420.

Figure 15:
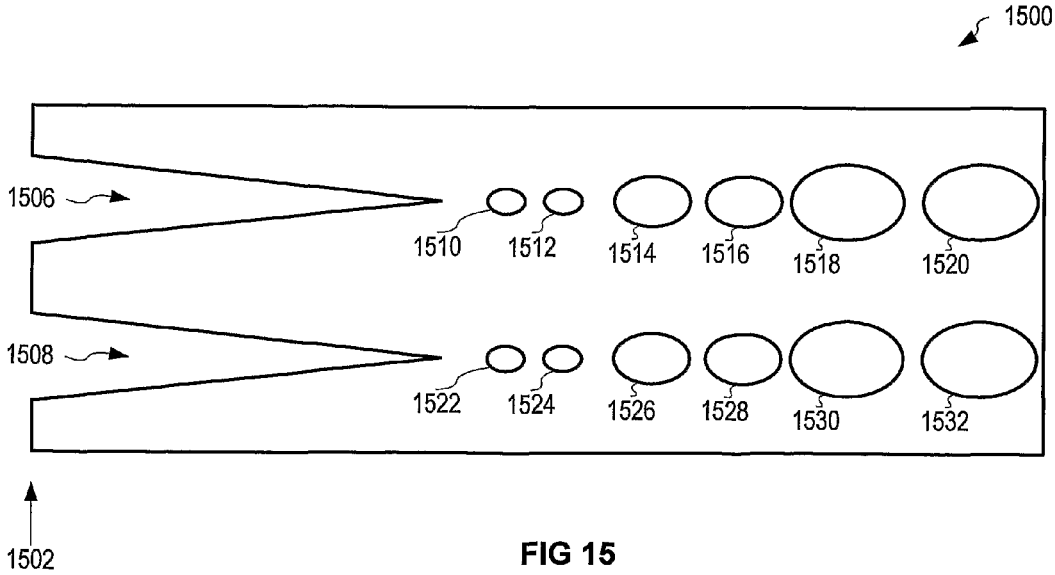
FIG. 15 shows a foil suitable for producing the winding of FIG. 14.

FIG. 15 shows a foil 1500 suitable for producing winding 1419, FIG. 14. FIG. 15 is illustrative and may not be drawn to scale. Foil 1500 is wound (starting at end 1502) to form winding 1419. Cutouts 1506 and 1508 of foil 1500 form cavities 1424 and 1425 of winding 1419, respectively. Cutouts 1510, 1514 and 1518 form cavity 1422; cutouts 1522, 1526 and 1530 form cavity 1423; cutouts 1512, 1516 and 1520 form cavity 1426; and cutouts 1524, 1528 and 1532 form cavity 1427. As appreciated, cutouts 1506 through 1532 are illustrative; additional or fewer cutouts may be made in foil 1500 prior to forming winding 1419.

As appreciated, other configurations of foil cutouts may be used to form cavities of windings for magnetic coils with different numbers of gaps, or for magnetic coils with gaps in different positions. One example includes UU cores instead of EE cores (where 'U' and 'E' represent core piece shapes), and has gaps in both legs (and coils wound around each leg), or may have a gap in just one leg. In another example, UI or EI cores (where 'U', 'I' and 'E' represent core piece shapes) may be used with gaps at the joint between the 'I' piece and the 'U' or 'E' piece and a cavity correspondingly positioned.

Note that the invention also works well for current waveforms that contain one or more large low-frequency AC components and one or more smaller high-frequency AC components, if the frequencies of the low-frequency components are low enough that the resistance at those frequencies are near the dc resistance of the winding.

Changes may be made in the above methods and systems without departing from the scope hereof. It should thus be noted that the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall there between.

What is claimed is:

1. A method for reducing AC losses in a magnetic coil, comprising:

forming at least one gap in a magnetic core, the gap being centered upon a plane of symmetry normal to an axis defined by a first post and a second post of the magnetic core;

winding one or more pieces of foil to form a foil winding such that (a) an inner diameter of the winding defines an opening for the first post and the second post, and (b) successively overlapping cutouts in the one or more pieces of foil form a cavity adjoining the opening and extending in an outboard direction from the opening; and positioning the foil winding so that the opening is substantially symmetrical with respect to the axis, and the cavity is substantially symmetrical with respect to the plane of symmetry and the gap to reduce the AC losses.

2. The method of claim 1, the step of winding one or more pieces of foil comprising forming the foil winding from two or more pieces of shaped foil.

3. The method of claim 1, wherein the magnetic core forms a winding window, and wherein the step of winding one or more pieces of foil comprises forming the foil winding such that a maximum width of the cavity is equal to twice a winding window width when the gap is located on only one side of the winding window.

4. The method of claim 1, wherein the magnetic core forms a winding window, and wherein the step of winding one or more pieces of foil comprises forming the cavity such that a maximum width of the cavity is equal to a winding window width when the gap is located on both sides of the winding window.

5. The method of claim 1, the step of winding one or more pieces of foil comprising forming the foil winding to form at least one semicircular shaped cavity.

6. The method of claim 1, the step of winding one or more pieces of foil comprising constructing the foil winding to form at least one 'V' shaped cavity with an open side of the 'V' nearest to the gap and a vertex of the 'V' further from the gap than the open side.

7. The method of claim 1, the step of winding one or more pieces of foil to form a foil winding comprising constructing the foil winding to form at least one cavity approximating a semicircular shape.

8. A magnetic coil with reduced AC losses, comprising:

a magnetic core having a first post and a second post extending towards one another along a first axis to define at least one gap between the first post and the second post, the gap being centered upon a plane of symmetry proceeding normal to the first axis; and a foil winding that circumscribes the first post, the second post and the gap, and forms an inner diameter that defines an opening that is substantially symmetrical with respect to the first axis;

the opening adjoining at least one cavity corresponding to a series of cutouts formed in adjacent layers of the foil winding, the at least one cavity (a) extending in an outboard direction from the first post and the second post, and (b) being substantially symmetrical with respect to the plane of symmetry.

9. The magnetic coil of claim 8, wherein the magnetic core comprises:

a winding window having a winding window width; and one or more gaps on one side of the winding window:

wherein a maximum width of each cavity is equal to twice the winding window width.

10. The magnetic coil of claim 8, wherein the magnetic core comprises:

a winding window having a winding window width; and the at least one gap is on both sides of the winding window;

wherein a maximum width of each cavity is equal to half of the winding window width.

11. The magnetic coil of claim 8, wherein the at least one cavity comprises a semicircular shape.

12. The magnetic coil of claim 8, wherein the at least one cavity comprises a 'V' shape with an open side of the 'V' nearest to the gap and a vertex of the 'V' further from the gap than the open side.

13. The magnetic coil of claim 8, wherein the at least one cavity comprises an elliptical shape.

14. A method for constructing a foil winding for a magnetic coil, comprising:

forming one or more gaps in a magnetic core, each of the gaps defining a plane of symmetry that is normal to an axis defined by a first post and a second post of the magnetic core; and forming one or more cavities in the foil winding by (a) forming one or more pieces of foil to form cutouts, and (b) winding the one or more pieces of foil such that each of the cavities forms from overlapping the cutouts as successive layers of the foil form the foil winding, wherein each of the one or more cavities, when integrated with the magnetic core, is adjacent to a corresponding one of the gaps and substantially symmetrical with respect to the plane of symmetry, to reduce an AC loss.

15. A method for constructing a magnetic coil, comprising:

forming a magnetic core having a first post and a second post extending towards one another along a first axis to define at least one gap between the first post and the second post, each such gap defining a plane of symmetry proceeding normal to the first axis;

forming a winding from one or more pieces of foil that form cutouts, such that the winding circumscribes the first post, the second post and the gap to define an opening that is substantially symmetrical with respect to the first axis, the opening including at least one cavity, formed by successive overlap of the cutouts, that extends in an outboard direction from the first post and the second post, the cavity being substantially symmetrical with respect to the plane of symmetry; and coupling the winding with the magnetic core such that the at least one gap is adjacent to the at least one cavity.

* * * * *